US006357055B1

(12) United States Patent
Gambla et al.

(10) Patent No.: US 6,357,055 B1
(45) Date of Patent: Mar. 19, 2002

(54) TOILET OVERSPRAY SHIELD FOR MALES

(76) Inventors: Eve Gambla, 17146 Deer Creed Dr., Orland Park, IL (US) 60467; John Manzella, 3636 S. Emerald Ave., Chicago, IL (US) 60609

( * ) Notice: Subject to any disclaimer, the term of this patent is extended or adjusted under 35 U.S.C. 154(b) by 0 days.

(21) Appl. No.: 09/879,647

(22) Filed: Jun. 12, 2001

(51) Int. Cl.[7] ..... E03D 9/00; F15D 1/00
(52) U.S. Cl. ..... 4/300.3; 4/DIG. 5
(58) Field of Search ..... 4/300.3, 661, 902, 4/DIG. 5

(56) References Cited

U.S. PATENT DOCUMENTS 5,117,512 A * 6/1992 Bressler ..... 4/300.3
5,983,410 A * 11/1999 Webster ..... 4/300.3

FOREIGN PATENT DOCUMENTS

JP 2-261137 A * 10/1990 ..... 4/300.3

* cited by examiner

*Primary Examiner*—Gregory L. Huson
*Assistant Examiner*—Tuan Nguyen
(74) *Attorney, Agent, or Firm*—JoAnne M Denison; Denison & Assoc, PC

(57) ABSTRACT

A removable urine overspray shield especially suited to young boys which is provided with upstanding semi-elliptical walls which removably engage with the lower portion of the inner rim of a toilet bowl when the toilet seat is upstanding. The rear of the device is provided with fastening means of a curved flange which sits and bears upon the lower portion of the inner toilet seat when in use, although other commonly known fastening means, such as a clip or Velcro strips may be used. In such a fashion, the device may be easily lifted onto and away from the toilet bowl rim. To facilitate insertion and removal on a toilet, a handle may be provided at the rear or top portion of the device. The device is intended to promote proper toileting in young boys and prevent urine from spraying on the walls and floors adjacent the toilet.

9 Claims, 1 Drawing Sheet

TOILET OVERSPRAY SHIELD FOR MALES

FIELD OF THE INVENTION

The present invention relates to the field of sanitary devices and more particularly those that removably attach to a toilet and prevent unwanted spray from urine outside the toilet bowl and onto floors and walls.

BACKGROUND OF THE INVENTION

In reviewing the prior art, there are a number of toilet shields which are directed toward the hygienic purpose of preventing urine from being deposited or sprayed in places other than the toilet bowl. Unfortunately, all of these designs are permanently installed with fastener holes in the toilet seat.

For example, U.S. Design Pat. No. 394,900 issued to Tae ChoKang, discloses a particular splash guard toilet shield that is tapered from back to front and which attaches to a toilet seat by means of a fastener in a permanent fashion. However, the lack of height in the walls of the device and the need to use permanent fastening elements make it somewhat difficult to use on a regular basis.

Further, U.S. Pat. No. 5,815,851 issued to R. S. Perry discloses the use of a two part system in which a shield portion fits radially about the inner rim of a toilet seat and which is permanently secured with fastening elements, and a removable cuff is secured to the toilet bowl by means of friction and pressure with the cuff. However, the cuff appears to rise up only a few inches from the seat, and then it flares outwardly, which may be insufficient to prevent urine overspray from young children.

Similarly, in U.S. Pat. No. 5,564,135 issued to C. Jones, et al. is disclosed the use of a permanently attached base plate having a flange which carries an accordion shaped shield which is automatically raised each time the toilet seat is raised much like a baby buggy's canopy.

Thus, nowhere in the prior is seen a simple, effective, easy to use and manufacture toilet seat shield which can be easily placed upon a raised toilet seat when desired, and then removed in a single motion when the device is no longer in use.

SUMMARY OF THE INVENTION

The present invention consists of a urine overspray shield which is approximately one quarter inches in thickness, and extends upwardly from the inner rim of a toilet bowl to a height of approximately 10" to 12" from the lower portion of the inner rim. The walls of the device are therefore semi-elliptical in construction. The upper portion of the shield may be domed. The back or rear exterior portion of the toilet shield is provided with a handle as well as attachment means for attaching the urine shield to the lower portion of a raised toilet set. The attachment means may consist of a biased clip, or a curved flange or even strips of Velcro or any other easily used removable attachment means. Any attachment device may be used as long as it is simple in design and construction such that a young child may readily use it.

The device itself may be easily and economically constructed from a single sheet of molded thermoplastic or other polymer which is light weight and easy to clean. The shield may act both as a channeling device to direct the flow of urine into a toilet bowl, and it can act as an overspray guard. It will also encourage good habits in young boys by ensuring that the toilet seat is in the upright position prior to urinating into the toilet because the toilet seat must be in its upright position in order to use the device.

Of course, it is anticipated that the device is sufficiently simple to use such that even a very young child can easily place the device onto a toilet seat and then remove it when he is done or decides to lower the seat. The device should be made from material that is sufficiently lightweight that it is easily lifted and manipulated by a young child. As another adaptation of the present device, cartoon or licensed characters and even a bulls-eye can be placed as stickers on the interior of the device to make an amusing game out of proper toilet use.

OBJECTS OF THE INVENTION

Thus, it is one primary object of the present invention to provide a simple lightweight toilet shield that is easily and readily placed within the rim portion of a toilet bowl when a toilet seat is in its raised position.

It is yet another object of the present invention to provide a urine overspray shield which extends from the rim of a toilet bowl upwardly to a height of approximately 10" to 12" inches to make it extremely difficult for a person to overspray the shield with urine falling on the floor or walls.

It is yet an additional object of the present invention to provide a urine over-spray shield which is essentially semi-elliptical in configuration with a pleasing domed top.

And, it is a further object of the present invention to provide a urine overspray shield which is made of a lightweight thermoplastic or other polymeric substance which is essentially one piece in construction, making it easy to clean.

It is still a further object of the present invention to provide a urine overspray shield with attachment means which is very simple and economical in construction and which can consist of a simple biased clip, a curved flange, or even Velcro strips, which even a young child may find easy to use.

It is yet an additional object of the present invention to provide a urine overspray shield which can only be used on a raised toilet seat, so as to teach a young child proper toileting habits of always raising the toilet seat prior to urinating.

And, it is still an additional object of the present invention to provide an interior with amusing images, such as cartoon or licensed characters or even a bulls-eye to make proper toileting an amusing game.

These and other objects and advantages of the present invention can be readily derived from the following detailed description of the drawings taken in conjunction with the accompanying drawings present herein and should be considered as within the overall scope of the invention.

DETAILED DESCRIPTION OF THE DRAWINGS

Figure 1:
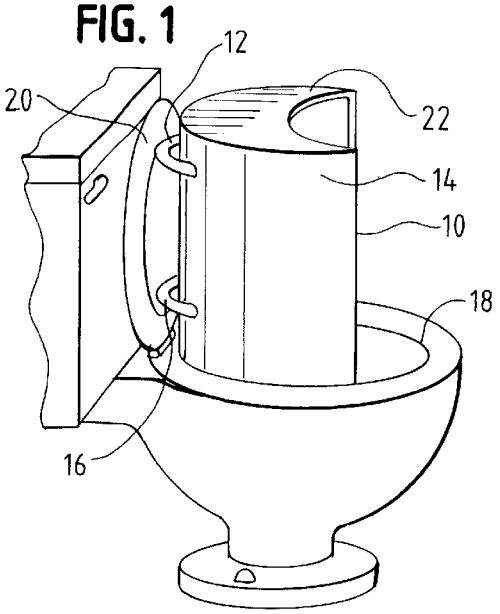
FIG. 1 is a left side perspective view of the present invention showing the device in use sitting within the toilet bowl attached to the lower portion of the inner toilet seat.

Shown now in FIG. 1 is one embodiment of the present invention, toilet overspray shield 10 which is provided with handle 12 along its upper exterior cylindrical wall 14, and curved flange 16 along its lower exterior cylindrical wall 14. In such a manner, overspray shield 10 may be easily attached to and removed from the lower portion of toilet seat 20. The overspray shield 10 simply is placed within the toilet bowl rim 18 after the toilet seat 20 has been lifted. When the device is no longer in use, it may be lifted off of toilet seat by means of handle 12. Of course, it is intended that overspray shield 10 is preferably made from a lightweight thermoplastic which is simple to blow mold or injection mold, or it may be made from a rigid polymer which is very sturdy but lightweight. In this particular version of overspray shield 10, the top is domed 22 for an attractive appearance and to prevent further splashing from a urine stream.

Overspray shield 10 is thus capable of directing and channeling the flow of a stream of urine into a toilet without worrying about the spray falling on the floor or walls of the bathroom. It is simple, convenient and easily installed to and from a toilet, such that even a very young child can use the device. Further, it teaches a young child proper toileting skills by requiring that toilet seat 20 be in an upright position before using the toilet. It is anticipated that the overspray shield is approximately 10" to 12" in height to ensure that all spray is channeled into the toilet bowl 18 and that nothing ends up on the floor or walls of the bathroom.

Figure 2:
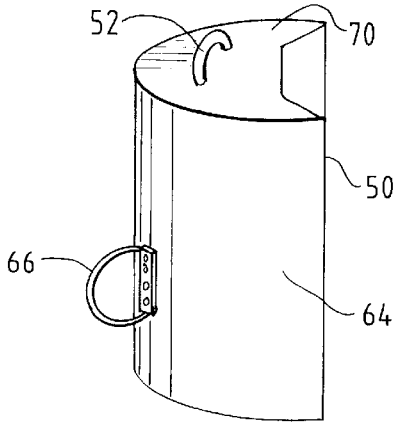
FIG. 2 is a left side perspective view of an alternate version of the present invention with miniature hook and loop attachment means.

FIG. 2 shows an additional preferred embodiment of overspray shield 50 in which the semi-elliptical exterior wall 64 has a flat top 70. In this particular view is shown the bottom edge 68 which fits snugly and firmly against the interior of a toilet bowl rim. Flat top 70 is further provided with handle 52 for easy insertion and removal of the device. In this particular embodiment, however, is shown miniature hook and loop fastener strip 66 that quickly and conveniently can wrap about any portion of the toilet seat when it is in an upright position. In such a manner, the miniature hook and loop fastener strip 66 is a relatively inexpensive fastening device that readily mounts to overspray shield 50 during manufacture, and moreover, it is quick and easy to clean.

Figure 3:
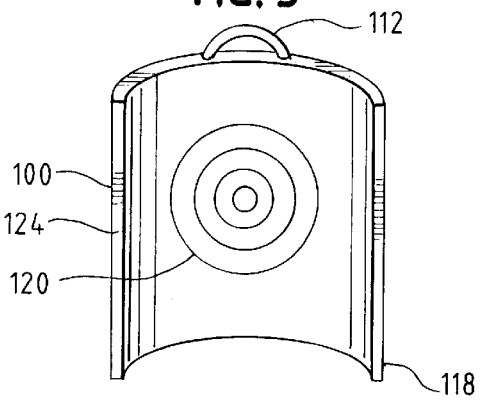
FIG. 3 is a front perspective view of an alternate version of the present invention with an amusing image provided on the interior back wall of the device.

FIG. 3 shows yet another preferred embodiment of the present invention overspray shield 100 wherein a semi-elliptical wall 124 does not end in an end cap, but is a much simpler version of the embodiments of overspray shields shown in FIGS. 1 and 2, above. In this particular embodiment, a handle 112 is simply provided at the top portion of semi-elliptical wall 124 for easy insertion and removal onto a toilet bowl rim. The lower portion of the shield 118 is able to easily bear upon and stabilize the device upon a toilet bowl rim for secure installment thereupon. Additionally, in this preferred embodiment, a bulls-eye or amusing image 120 may also be provided to make toileting fun for young children.

Figure 4:
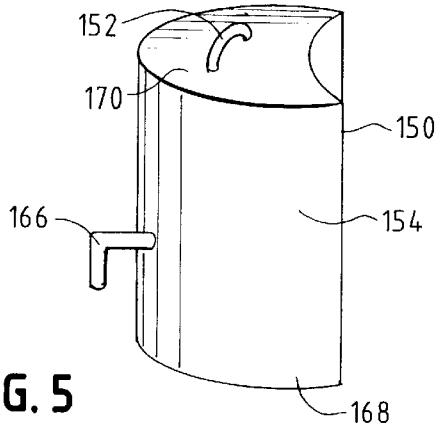
FIG. 4 is a side view of an alternate version of the present invention that utilizes biased clamping means for attachment to a raised toilet seat.

FIG. 4 shows yet an additional preferred embodiment of the present invention, overspray shield 150 which shows the use of a flat top 170 which is provided with a handle 152 for easy insertion and removal of the device. It is believed that a handle on top of the device is easier to use than a handle located on the back of the device. A semi-elliptical outer wall 154 is also provided to which is attached at its upper portion a biased clip 166 which is capable of bearing upon the lower portion of a toilet seat is provided for the securing of the device to an upstanding toilet seat. This overspray shield 150 is also provided with a curved lower portion 168 to assist in properly draining urine into the toilet bowl and to further stabilize the device. Of course, the bias clip 166 may be made from the same plastic used for the overspray shield 154 and be integral to the shield, or it may be made from a durable steel or other semi-flexible material suitable for biasing means.

Figure 5:
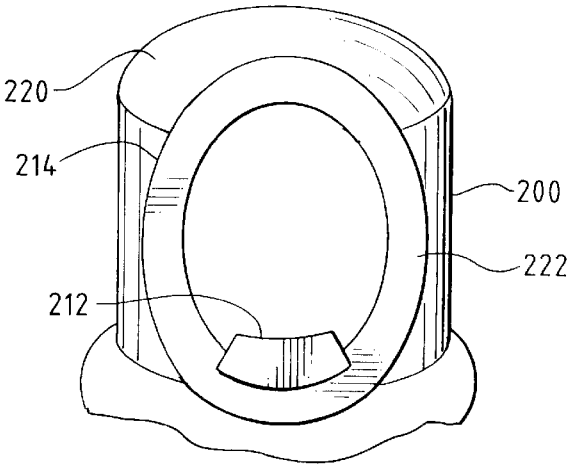
FIG. 5 is a cut away rear perspective view of the present invention that utilizes a curved flange for attachment means to a raised toilet seat.

FIG. 5 shows yet an additional preferred embodiment of the present invention in which overspray shield 200 is provided with a domed top and a curved flange 212 which is attached to the posterior portion of semi-elliptical curved wall 214. This figure shows how the curved flange 212 easily slips onto and off of toilet seat 222. In this particular embodiment, the top of overspray shield 200 is domed 220 for containing urine spray and its pleasing appearance.

Although in the foregoing detailed description the present invention has been described by reference to various specific embodiments, it is to be understood that modifications and alterations in the structure and arrangement of those embodiments other than those specifically set forth herein may be achieved by those skilled in the art and that such modifications and alterations are to be considered as within the overall scope of this invention.

What is claimed is:

1. A toilet over-spray shield which is constructed from a thermoplastic or other polymeric substance, the over-spray shield having walls which are substantially semi-elliptical in configuration which are adapted to removably set within a toilet bowl, the semi-elliptical walls formed a semi-cylindrical wall having a lower exterior cylindrical wall being placed within a toilet bowl in use and an upper exterior cylindrical wall being raised up from the toilet bowl rim substantially at least eight inches, and the over-spray shield further having means for attaching the over-spray shield to a lower seat portion of a raised toilet seat in use, wherein the means for attaching is located on the lower exterior cylindrical wall and allowed the over-spray shield to be removed when the toilet seat is in a lower position which is adjacent to the toilet rim.

2. The toilet over-spray shield of claim 1 further having a domed top which is integral to the semi-elliptical walls of the shield.

3. The toilet over-spray shield of claim 1 wherein the attachment means consists of a curved flange.

4. The toilet over-spray shield of claim 3 wherein the curved flange is integral with the lower exterior cylindrical wall.

5. The toilet overspray shield of claim 1 having a handle for easy insertion and removal of the over-spray shield is provided on the upper exterior cylindrical wall.

6. The toilet overspray shield of claim 1 wherein the attachment means consists of at least one miniature hook and loop fastener which may wrap about the lower seat portion of the raised toilet seat for securing the over-spray shield thereto.

7. The toilet overspray shield of claim 1 wherein the attachment means consists of a biased clip which may bear upon and secure the over-spray shield to the lower seat portion of the raised toilet seat when the over-spray shield is in use.

8. The toilet overspray shield of claim 1 wherein the semi-cylindrical wall further has an interior wall portion provided with an amusing image.

9. The toilet overspray shield of claim 1 further having a top portion and the top portion is further provided with a handle to easily install and remove the over-spray shield from the raised toilet seat and the interior of a toilet bowl.

* * * * *